US005178087A

United States Patent [19]

O'nion et al.

[11] Patent Number: 5,178,087

[45] Date of Patent: Jan. 12, 1993

[54] MOORING DEVICE

[75] Inventors: Geoffery O'nion, Monte Carlo, Monaco; Jean C. Gramet, Beaulieu, France

[73] Assignee: Single Buoy Moorings, Inc., Marly, Switzerland

[21] Appl. No.: 642,216

[22] Filed: Jan. 16, 1991

[51] Int. Cl.[5] ..... B63B 21/00

[52] U.S. Cl. ..... 114/230; 114/293

[58] Field of Search ..... 114/265, 264, 230, 144 B, 114/254, 293, 294; 212/191; 441/3-5; 414/138.4; 166/354; 405/224

[56] References Cited

U.S. PATENT DOCUMENTS 4,630,542 12/1986 Peyre et al. ..... 212/191 X 4,936,710 6/1990 Petty et al. ..... 114/265

*Primary Examiner*—Edwin L. Swinehart

*Attorney, Agent, or Firm*—Young & Thompson

[57] ABSTRACT

Mooring device comprising a vessel with a turntable or the like to which anchor lines are connected extending in different directions and which is rotatable about a vertical axis, which anchor lines, preferably at or adjacent to the point of connection with the vessel, are provided with a hydraulic device which upon overload of one or more of the anchor lines allows extension so that in extremely heavy weather conditions the loads on mooring lines and vessel can be kept under control.

8 Claims, 4 Drawing Sheets

MOORING DEVICE

BACKGROUND OF THE INVENTION

The present invention relates to a mooring device comprising a floating device, such as a vessel, said floating device supporting a rotatable body, such as a turntable or turret, which body is rotatable about a vertical axis and has means for connecting thereto anchor lines which according to catenary lines extend in different directions to anchors at the bottom of the body of water.

The prior art knows a plurality of mooring devices of this type. Examples are found in U.S. Pat. No. 4,650,431 or U.S. Pat. No. 4,580,986.

The floating device or vessel usually is a tanker and from said tanker extends at least one hose towards a swivel above the turntable or turret and from said swivel at least one hose extends through the turntable or turret towards the bottom of the body of water where said hose is connected to a well or a pipe line. The anchor lines keep the vessel in place and allow displacement of the vessel under the influence of wind, waves and currents against a restoring force which is generated by the anchor lines. The anchor line or lines which extend away from the direction in which the vessel is displaced are more or less tightened during displacement or in other words function as a spring which rapidly becomes more and more rigid. Under normal weather conditions including storms this forms no problem.

However, if an exceptionally heavy storm occurs, such as the type of storm which statistically occurs only once in a century, or during typhons, then the loads on anchor lines and vessel exceed a permissible maximum.

SUMMARY OF THE INVENTION

Purpose of the invention is to provide a mooring device which can cope with such an exceptional situation.

According to the invention this is achieved in that each anchor line between its anchor and its connecting point at the said body has been provided with a hydraulic device having a hydraulic circuit comprising an accumulator and a pressure relief valve, which valve allows flow of hydraulic fluid from the hydraulic device towards the accumulator if the load in the respective anchor line exceeds a predetermined value allowing lenthening of the anchor line, said circuit allowing return of the fluid from the accumulator towards the device through a non-return valve if the load reduces, thus shortening the anchor line.

This means that up to a predetermined load in the anchor lines they will function according to their normal catenary fashion. However, as soon as the maximum permissible value of the load is reached the pressure relief valve opens, the connection between said hydraulic device and the accumulator allowing said hydraulic device to give way.

Said hydraulic device can be a piston cylinder unit having one end attached to the body and the other end to an anchor line so that the anchor line can be paid out as soon as the pressure relief valves open the connection.

Said hydraulic device also can be a hydraulic winch placed on the body and having an anchor line wound upon its drum. As soon as the pressure relief valve opens the connection the hydraulic motor of the winch can start to rotate, which motor of course has to be of the positive displacement type, and the anchor line can be paid out.

A winch has the advantage that a considerable length of anchor line can be paid out. With the piston cylinder unit said length is restricted unless, as provided by the invention as well, the piston cylinder unit is placed between the spaced apart discs of a tackle over which a top-end cable of the anchor line is guided.

The accumulator can be preloaded and each hydraulic device can have its own accumulator or there may be a common accumulator for a number if not all hydraulic devices.

The pressure relief valve may be adjustable and can have remote control.

Each time the maximum load is reached during heavy weather conditions the load will during some time hardly further increase, a further increase only occurring as soon as no further length can be paid out, e.g. in case the piston cylinder unit is at the end of its stroke.

Once the load decreases in the anchor line the pressure will drop and the pressure relief valve will close. The accumulator then will return hydraulic fluid through the return line with non return valve towards the hydraulic device so that the original situation is restored.

In case paying out of one or more anchor lines at one side of the vessel takes place the anchor lines extending in opposite directions will slacken. By giving the accumulator a preload the accumulator can take care of taking in anchor line to avoid its slackness.

It then may be necessary to provide the relief valve with a remote control by means of which its opening pressure can be adjusted or its opening can be performed any how to enable return to the original position.

DESCRIPTION OF THE FIGURES

Figure 1:
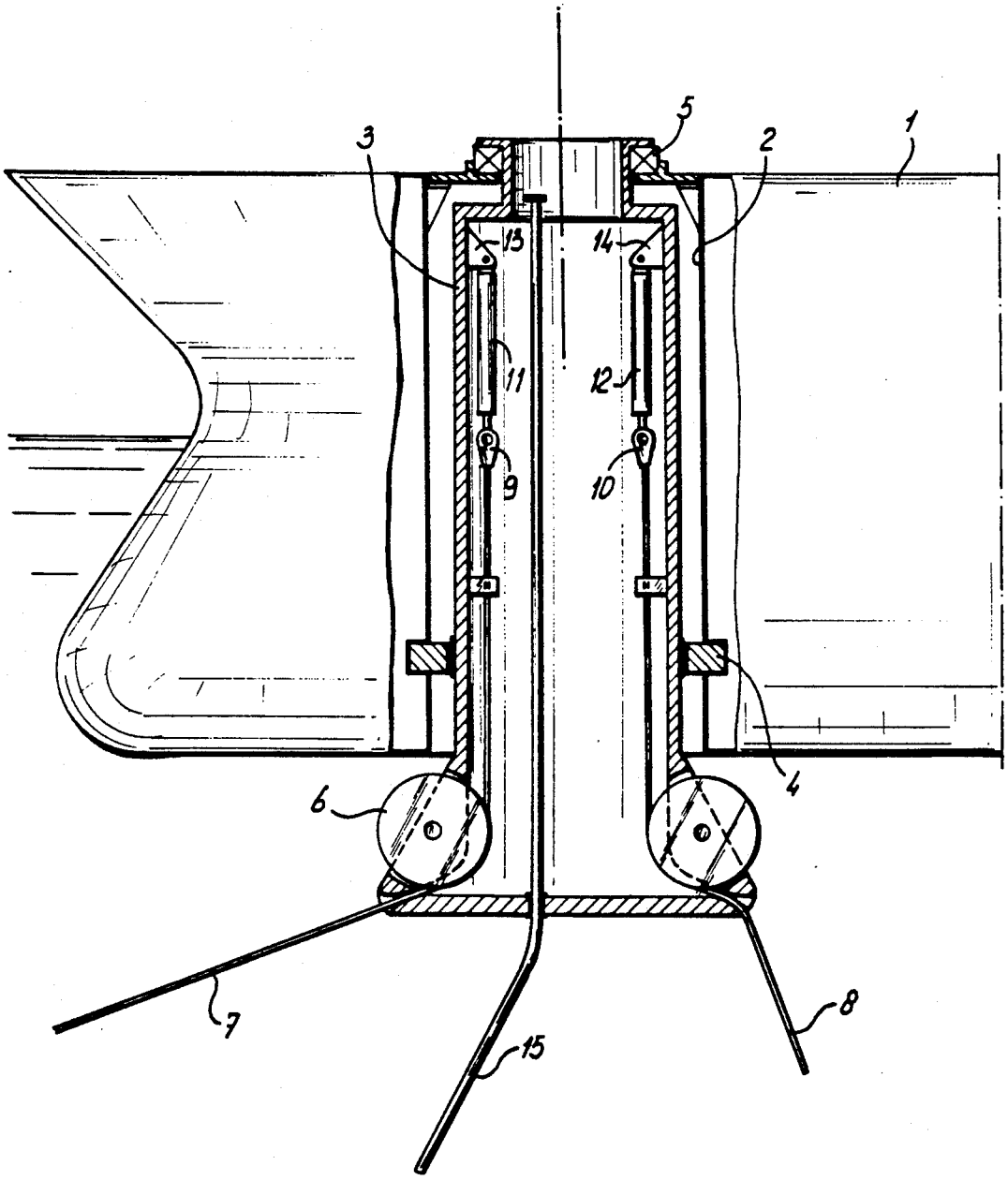
FIG. 1 is a diagrammatic cross sectional view of a mooring device according to the invention.

FIG. 1 shows a vessel 1 having adjacent to the bow a cylindrical hollow space 2 within which a turret 3 is rotatably supported by means of bearings 4 and 5.

The turret has at its lower end below the bottom of the vessel 1 a plurality of guide wheels 6 for anchor lines such as 7 and 8 which extend in different directions.

The upper ends 9 and 10 respectively of said anchor lines are connected to cylinder piston units 11 and 12 respectively which are attached to brackets 13 and 14 respectively on the inner wall of the turret. A riser 15 extends through the interior of the turret upwardly towards a not shown swivel.

Figure 2:
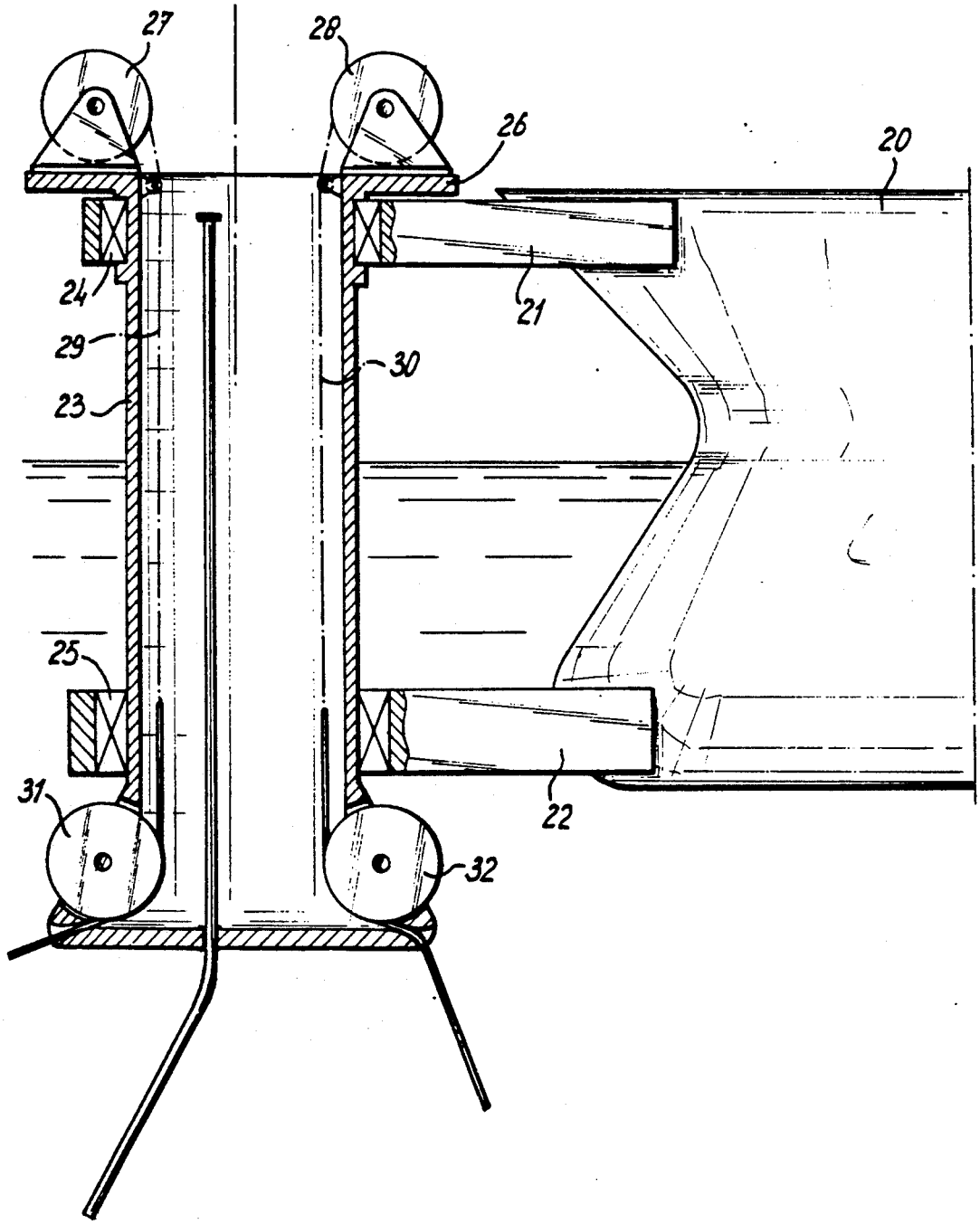
FIG. 2 shows an alternative of the mooring device according to the invention.

FIG. 2 discloses a vessel 20 having at its bow forwardly extending arms 21 and 22 within which a sleeve-like turret 23 is supported by means of bearings 24 and 25.

The turret 23 has at its upper end an annular platform 26 upon which winches 27, 28 are placed from which anchor cables 29, 30 extend downwardly through the interior of the turret and over guide wheels 31, 32 towards the bottom of the body of water.

It is observed that in drilling vessels it is known to provide the moonpool with a rotatable sleeve carrying winches for anchor lines which extend in different directions, which winches have to keep the vessel at its proper location by properly tensioning the respective anchor lines. This prior art, however, does not know means which provide for exceptional load conditions.

Figure 3:
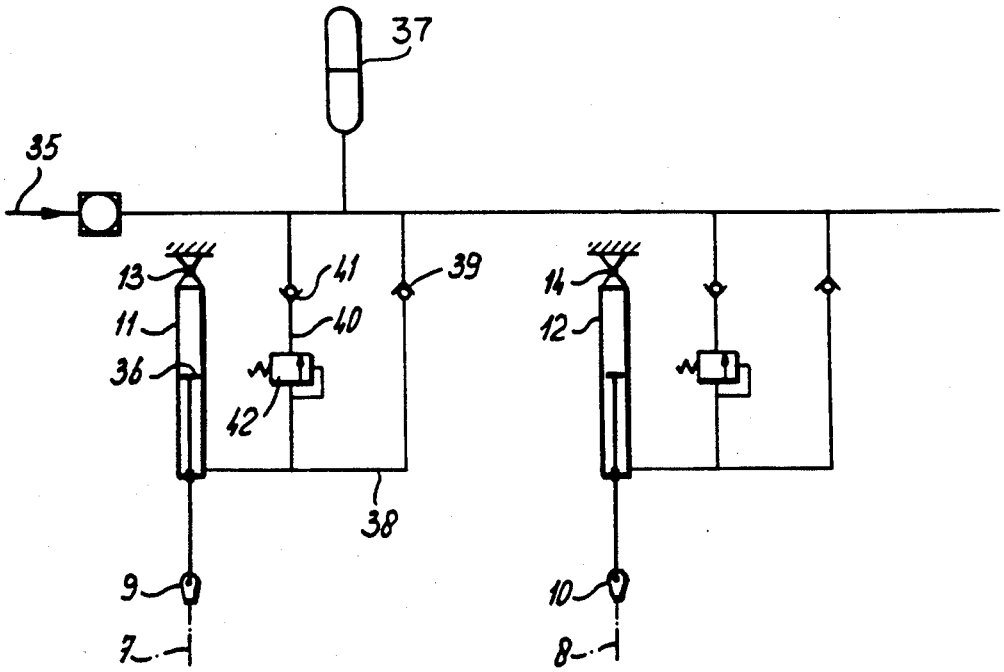
FIG. 3 gives the hydraulic diagram.
Figure 5:
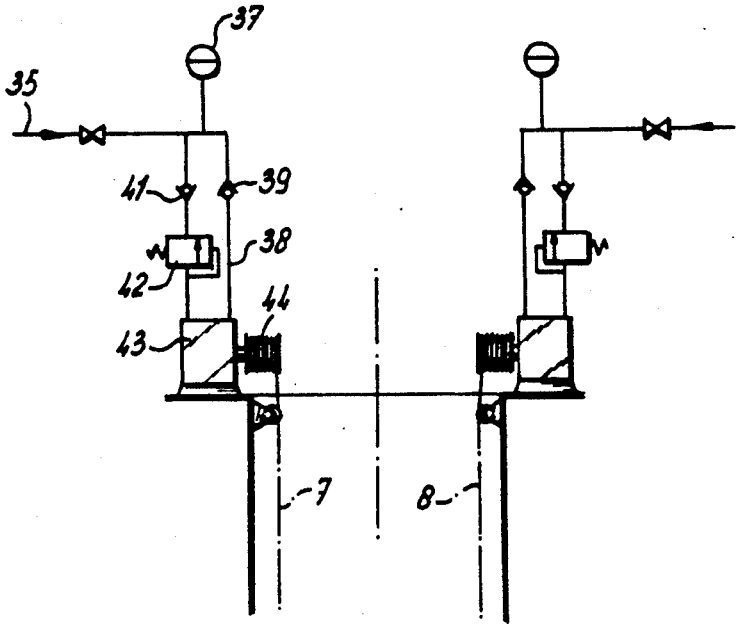
FIG. 5 discloses schematically the winches with hydraulic diagram of the embodiment of FIG. 2.

FIGS. 3 and 5 diagrammatically show the hydraulic systems.

In FIG. 3 the cylinder piston units 11 and 12 respectively of FIG. 1 are shown.

Hydraulic fluid can be supplied through line 35 to place piston 36 in its initial position as shown and to preload the accumulator 37. Supply of hydraulic fluid into cylinder 11 can take place through line 38 with non-return valve 39.

Line 40 between 38 and accumulator 37 has been provided with a non-return valve 41 and with a pressure relief valve 42.

Cable 7 has been attached at 9 to the piston rod of piston 36. Tension in cable 7 will tension the hydraulic fluid but nothing happens because piston 36 is prevented from moving by non-return valve 39 and pressure relief valve 42. As soon as the pressure, however, passes a predetermined value, e.g. 3000 psi, valve 42 is opened and hydraulic fluid then can flow from below piston 36 through pressure relief valve 42 and non-return valve 41 into the accumulator 37.

If the load reduces pressure relief valve 42 will close and accumulator 37 then can return hydraulic fluid through the non-return valve 39 into the cylinder 11 below piston 36.

In FIG. 5 the same references are used for the same parts as used in FIG. 3.

43 indicates a hydraulic motor of the positive displacement type which is connected with the drum 44 of the winch upon which the upper end of e.g. cable 7 has been wound. Rotation of drum 44 and motor 43 is prevented by non-return valve 39 and pressure relief valve 42 until the predetermined value is reached in which case valve 42 opens and motor 43 can rotate with paying out of cable 7.

As cable 8 on the other side will then slacken due to displacement of the vessel winding up might be desirable but is prevented by the pressure relief valve 42. In that case it might be useful to provide for remote control of the pressure relief valve to change its setting or to overrule the pressure setting.

Figure 4:
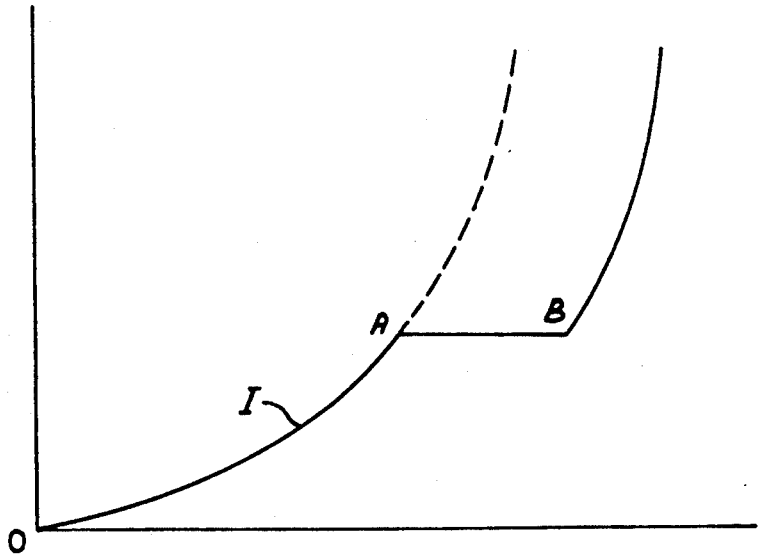
FIG. 4 gives a load-excursion diagram.

FIG. 4 discloses a load-excursion diagram. The first part I of the diagram between O and A, is the normal curve showing the increase of the load with increasing excursion which means increasing displacement of the vessel. As the interrupted line shows the spring action of a catenary line rapidly decreases with increase of the excursion or in other words the spring rapidly becomes rigid and no longer effectively functions as a spring.

At point A the predetermined value of the load is reached and the hydraulic devices start to pay out anchor line due to the fact that the pressure relief valve is opened. During said paying out between points A and B there practically is no increase of the load although a slight increase is possible depending on the preload of the accumulator.

From point B upwardly the original load-excursion curve returns or in other words the spring becomes more and more rigid but now after having allowed further displacement of the vessel.

The amount of displacement indicated by the horizontal line between A and B in FIG. 4 depends from the construction of the hydraulic devices.

With piston cylinder units, as shown in FIG. 1, the amount of displacement is limited.

With the winches, shown in FIG. 2, the distance of excursion between A and B can be considerably larger.

Figure 6:
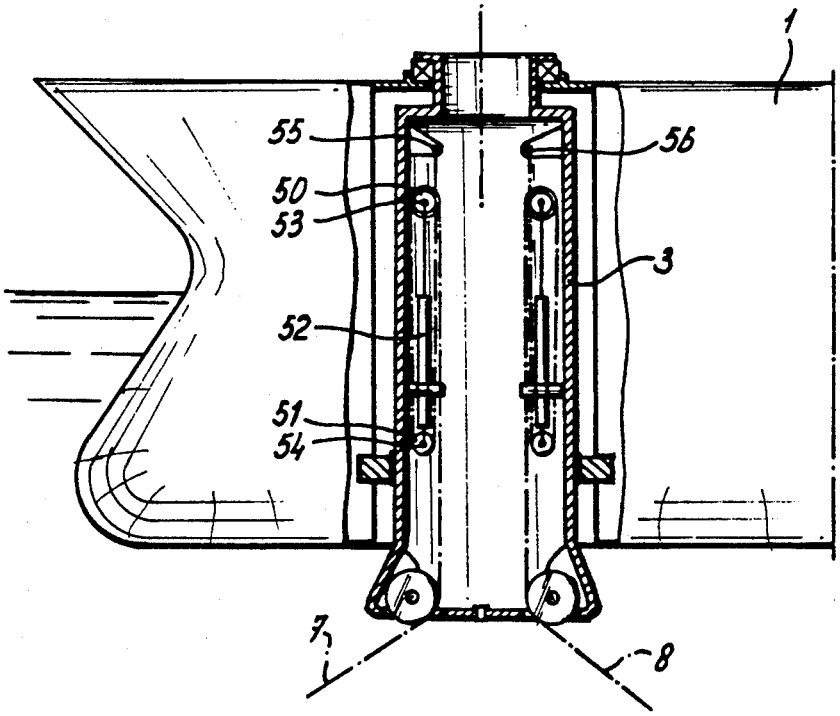
FIG. 6 schematically discloses another embodiment which makes use of piston cylinder units and tackles.

With piston cylinder units this, however, can be achieved as well if the principle of FIG. 6 is used.

FIG. 6 shows that in the turret 3 of the construction shown in FIG. 1 the anchor lines 7 and 8 respectively run several times over spaced apart sheaves 50, 51 of a tackle system with the piston cylinder unit 52 placed between the shafts 53 and 54 respectively of the tackle system. The ends of the cables have a fixed point of attachment at 55 or 56 respectively.

If the predetermined value of the load is reached the pistons of the piston cylinder units may move inwardly allowing the sheaves 50 and 51 to approach each other.

Dependent upon the number of sheaves and accordingly the number of passes of the cable around the tackle the relative displacement of the sheaves 50, 51 with respect to each other is multiplied allowing the paying out of a greater length of cable than is possible with the embodiment of FIG. 1.

We claim:

1. In a mooring device comprising a floating device, said floating device supporting a rotatable body, which body is rotatable about a vertical axis and has means for connecting thereto anchor lines which according to catenary lines extend in different directions to anchors at the bottom of the body of water; the improvement wherein each anchor line between its anchor and its connecting point at said body has a hydraulic device with a hydraulic circuit comprising an accumulator and a pressure relief valve, said valve allowing flow of hydraulic fluid from the hydraulic device towards the accumulator only if the load in the respective anchor line exceeds a predetermined value allowing lengthening of the anchor line, said circuit allowing return of the hydraulic fluid from the accumulator towards the device through a non-return valve if the load reduces, thus shortening the anchor line, said predetermined value being sufficiently high that the anchor line undergoes substantial straightening and hence a substantial increase in load before said valve opens.

2. Mooring device as claimed in claim 1, wherein the hydraulic device or devices is or are a cylinder or cylinders having one end attached to said body and the other end to the anchor line.

3. Mooring device as claimed in claim 1 wherein the hydraulic devices is or are a hydraulic winch or winches placed on the body and each having an anchor line attached thereto.

4. Mooring device as claimed in claim 1 wherein each hydraulic device has its own accumulator and its own relief valve.

5. Mooring device as claimed in claim 4 wherein the relief valve has a controllable bypass.

6. Mooring device as claimed in claim 4 wherein the relief valve is adjustable.

7. Mooring device as claimed in claim 1 wherein the accumulator or accumulators is or are respectively preloaded.

8. Mooring device as claimed in claim 2 wherein the hydraulic cylinder is placed between spaced apart sets of sheaves of a tackle around which an anchor line passes several times having its outer end fixed to the body and its other end extending towards the anchors.

* * * * *